US006342780B1

(12) United States Patent
Pickering

(10) Patent No.: US 6,342,780 B1
(45) Date of Patent: Jan. 29, 2002

(54) ZENER DIODE REFERENCE VOLTAGE STANDARDS

(75) Inventor: John Robert Pickering, Norwich (GB)

(73) Assignee: Metron Designs Ltd. (GB)

( * ) Notice: Subject to any disclaimer, the term of this patent is extended or adjusted under 35 U.S.C. 154(b) by 0 days.

(21) Appl. No.: 09/555,387

(22) PCT Filed: Sep. 29, 1999

(86) PCT No.: PCT/GB99/03233

§ 371 Date: May 31, 2000

§ 102(e) Date: May 31, 2000

(87) PCT Pub. No.: WO00/20941

PCT Pub. Date: Apr. 13, 2000

(30) Foreign Application Priority Data

Oct. 1, 1998 (GB) ..... 9821379

(51) Int. Cl.[7] ..... G05F 3/16
(52) U.S. Cl. ..... 323/313; 323/901
(58) Field of Search ..... 323/313, 901, 323/311, 907; 347/236, 247; 327/175; 372/25

(56) References Cited

U.S. PATENT DOCUMENTS 3,881,150 A * 4/1975 Gay ..... 323/311
3,962,718 A 6/1976 Inoue et al.
4,313,083 A * 1/1982 Gilbert et al. ..... 323/350
4,336,489 A * 6/1982 Frederiksen ..... 323/231
4,562,400 A * 12/1985 Narasimhan ..... 323/281
4,751,524 A * 6/1988 Balchunas ..... 346/108
4,774,452 A * 9/1988 Ahmed ..... 323/314
5,818,669 A * 10/1998 Mader ..... 361/18

OTHER PUBLICATIONS

Goodenough F.; "IC Voltage References, Better than Ever" Electronic Design, pp. 83–89, Sep. 22, 1988, vol. 36, No. 21.

Spreadbury, P.J.; "The Ultra–Zener . . . is it a portable replacement for the Weston cell?"; Measurement Science and Technology, pp. 687–690, vol. 1, No. 8.

* cited by examiner

*Primary Examiner*—Rajnikant B. Patel
(74) *Attorney, Agent, or Firm*—Amster, Rothstein & Ebenstein

(57) ABSTRACT

A method of operating a voltage reference element such as a zener diode comprises applying at least two current values to the device in respective periods of time one said value being such as to provide desired reference voltage characteristics of the device and the other being such that the average current during both periods provides a selected power dissipation to set a required temperature of operation of the device.

6 Claims, 3 Drawing Sheets

Bias Current
Time

S&H
1
8
9
10
11
12
13
14
15
16

ZENER DIODE REFERENCE VOLTAGE STANDARDS

BACKGROUND OF THE INVENTION

This invention concerns the operation of Voltage references dependent on the "Zener" or "Avalanche" characteristics of a semiconductor diode commonly referred to by those versed in the art as "Zeners", Zener Diodes or Zener References. This type of semiconductor device produces a relatively precise voltage across its cathode and anode for a range of currents passing through it in the reverse mode, that is the opposite direction, Cathode to Anode to that which produces normal diode function behaviour. For certain types of these diodes extremely stable voltage behaviour is realisable where the reverse current is set to a suitable and stable value.

It is one of the prime objectives of those making stable voltage reference standards based on the principle to minimise the Very Low Frequency (VLF) noise and long term random instability of output Voltage. It is a further objective to minimise the output voltage dependence on external. environmental conditions particularly variations in temperature and atmospheric pressure.

BRIEF SUMMARY OF THE INVENTION

It is generally known that random noise and instability generated by the Zener diode is reduced by increasing the junction area of the diode. However, this can further be improved by operating the Zener at an optimum current density which reduces the noise but, in a large area diode, can dissipate sufficient power to cause the Zener and its packaging to rise to such high temperature that oven temperature control becomes difficult or impossible without compromising the long term voltage stability of the Zener.

It is accordingly an object of the invention to provide means to operate a Zener diode reference of large junction area at an optimal current density whilst maintaining or controlling the temperature of the silicon chip on which the diode is diffused at a lower increment above the ambient temperature than would have prevailed without application of the invention.

The invention is illustrated by way of example in the accompanying drawings.

Figure 1C:
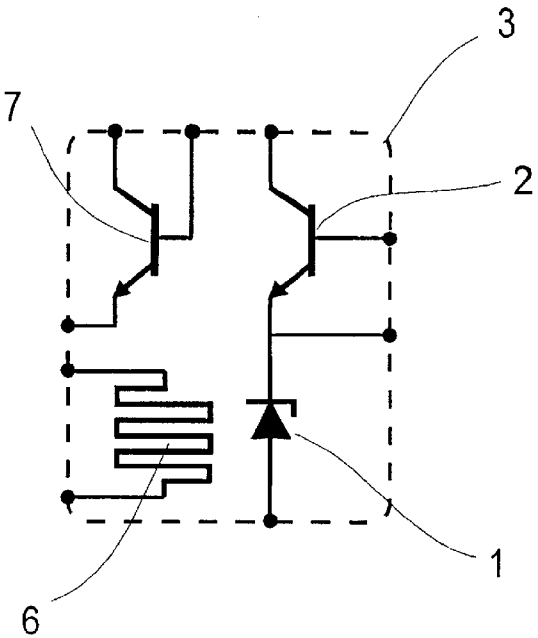
FIGS. 1*a*, 1*b* and 1*c* are schematic diagrams of known arrangements.
Figure 1B:
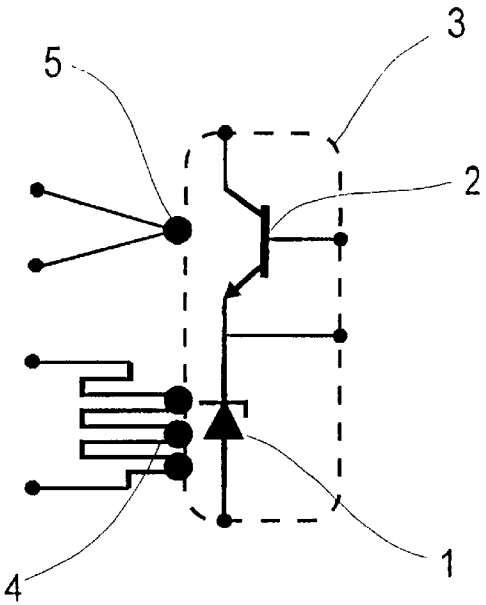
Figure 1A:
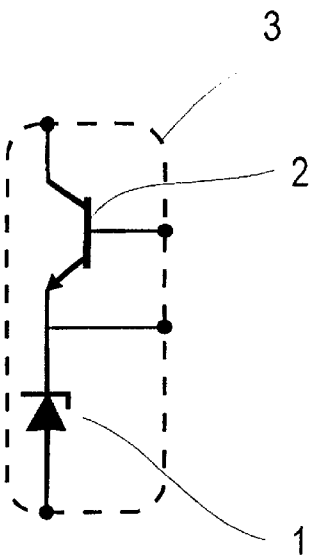

The arrangements known in the prior art include those of FIGS. 1*a*, 1*b* and 1*c*.

FIGS. 1*a* shows the schematic of a type of reference element that incorporates a Zener diode, 1, and a transistor, 2, in one thermal environment, 3, commonly a single silicon chip packaged in standard semiconductor device packaging well known to those versed in the art. In this example advantage is gained from using the transistor base to emitter voltage which is a voltage which reduces with increasing temperature, to add to the Zener voltage which increases with increasing temperature. This is known as a compensated Zener or a Reference Amplifier. A current, which is derived from circuiting coupled to the transistor in known manner but which for clarity is not shown in this or subsequent drawings, is passed through the transistor to bias it and the same or different current through the Zener, these currents being chosen such that the temperature coefficient of voltage of the output, which is the sum of the Zener voltage and the transistor base emitter voltage, is nominally zero.

In the illustration of FIG. 1*b*, a temperature sensor such as a thermistor, 5, and external oven, 4, is added in close thermal contact with the Zener to control the temperature of the simple embodiment of FIG. 1*a*, thus further reducing the effective temperature coefficient but necessarily resulting in a higher temperature of operation of the Silicon junctions unless cooling is used.

In the illustration of FIG. 1*c*, a further transistor, 7, is included to sense the temperature of the silicon chip and a heating element, 6, is diffused into the chip to allow its temperature to be adjusted. It is then a relatively simple matter for those versed in the art to use the transistor temperature sensor and the heater to control the temperature to a high degree of constancy.

It should be apparent that to provide a reasonable degree of control of chip temperature over varying ambient temperature then the arrangements of FIGS. 1*b* and 1*c* require that the silicon chip is operated at a significantly higher temperature than that which results from the circuit of FIG. 1*a* and that this in turn limits the magnitude of bias current through the Zener diode that can be chosen because of the power dissipation and self heating that results.

Figure 2B:
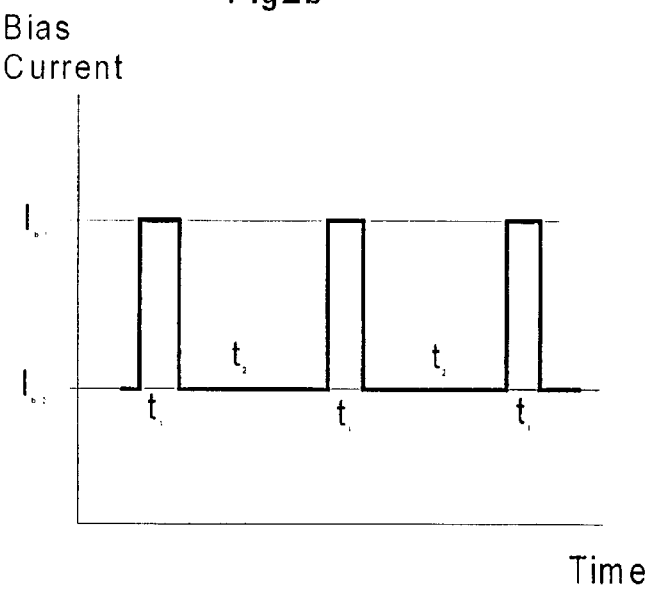
FIG. 2*a* illustrates the principle of operation of the invention with FIG. 2*b* showing the current waveform with two current periods.
Figure 2A:
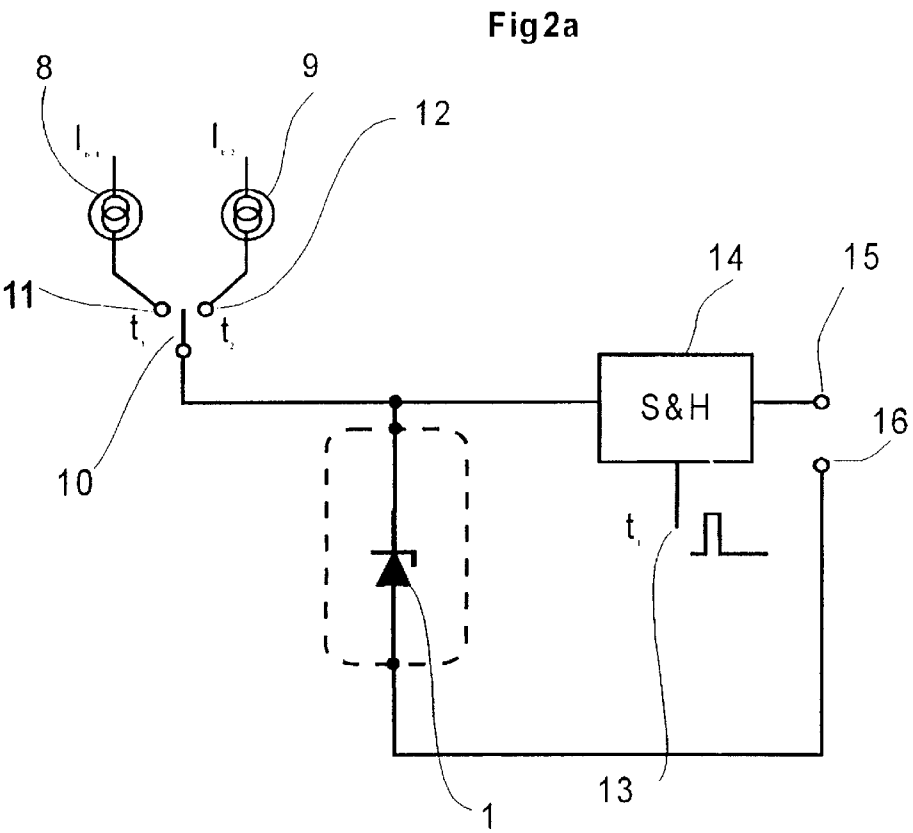

An arrangement in accordance with the invention and shown in FIG. 2*a* allows operation of the Zener diode at optimal current density by pulsing the bias current though it at a value equal or similar to the optimal current density and thus giving two or more distinct periods of operation which would normally, but not necessarily, be repeated continuously.

During the first period, $t_1$ a precisely defined current, $I_{b1}$ is passed through the Zener diode, 1, which may be a simple Zener diode as shown in FIG. 2 or a reference element similar to that of FIG. 1*a* and the resulting output voltage sampled and stored on the capacitor of the Sample and Hold or Track and Hold circuit, 14, being sampled during period $t_1$, 13, this being a well known technique for storing voltage values commonly used by those concerned with the design of Analogue to Digital Converters. $I_{b1}$ is the optimum bias current, 8, chosen to minimise the Random noise in the Zener, 1, and is typically too high for satisfactory continuous application. $I_{b1}$ is therefore turned off or reduced during a second period such that $I_{b2}$, a typically different current, 9, then flows through the Zener. This operation is symbolised by switch, 10, shown connected to $I_{b1}$, for period $t_1$, 11, and to $I_{b2}$ for period $t_2$, 12.

The value of $I_{b2}$ and the periods $t_1$ and $t_2$ for which $I_1$ and $I_{b2}$ respectively flow can thus be chosen so that the average current in the Zener provides an acceptable level of self heating where the total period $t_1$ plus $t_2$ is significantly faster than the thermal time constant (a measure of the speed of heating and cooling) of the Zener. A typical thermal time constant for this type of component is many tens of seconds so if the period $t_1+t_2$ is much less, say of the order of tens of milliseconds, temperature fluctuations during the sample time $t_1$ will be negligible and repeated sampling will give a steady output voltage shown on output terminals, 15, and 16. This output value will have less Low Frequency random voltage noise and instability because it is sampled at higher bias current than would be the case if it was measured continuously at lower bias current. It should be noted that pulse testing of electronic components, where test currents are pulsed on for the duration of the test but otherwise off is well known in the prior art. However, the object of this invention is to operate normally in this manner and to provide a second level of current $I_{b2}$ which can be chosen to give a specific degree of self heating or can be controlled to set a particular temperature of the Zener reference silicon chip and would not normally be zero or merely turned off. FIG. 2*b* is a simple graph showing the resulting current waveform with $I_2$ set for a particular level of power dissipation in the Zener. In practice this can be varied whilst leaving $I_{b1}$ and hence the output voltage at a constant value.

Figure 3:
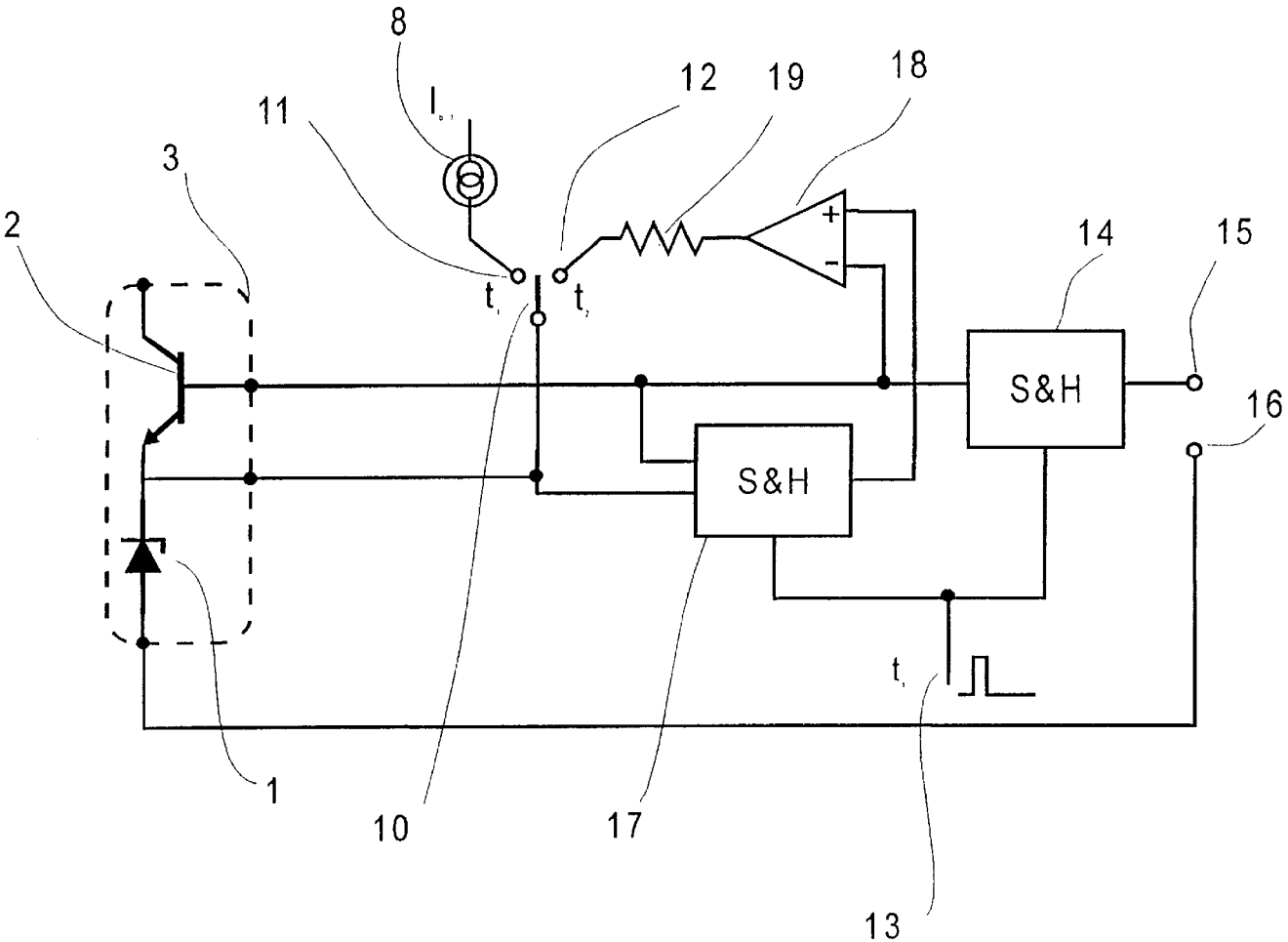
FIG. 3 illustrates the principle of the invention with a loop controlled second current period.

A more useful and sophisticated embodiment of the invention is shown in FIG. 3 where a Zener reference element as before, 1,2,3, is biased during time $t_1$ with current $I_{b1}$ as before but where $I_{b2}$ is replaced, during period $t_2$ with a current supplied by resistor, 19, and amplifier, 18. In this case the desired Zener voltage is sampled as before but also the base to emitter voltage (Vbe) of the transistor is sampled during period $t_1$ in a second sample and hold or track and hold, 17, to give a measure of the temperature of the silicon chip and thus of the components of the reference element. This sampled, temperature dependent, voltage is then used in a control loop by connecting to amplifier, 18, to control the magnitude of current through the-resistor, 19, during the second period $t_2$. It would also be possible to adjust the duration of the period $t_2$ with respect to period $t_1$, or to adjust both the magnitude of current and the relative period, but in either case the average sampled base emitter voltage Vbe and hence the chip temperature, Tc, is maintained at a constant value.

It should be appreciated that there are many variations to this design possible and that they may depend on the structure of the reference chosen. In particular, a third period of time may be included to allow temperature measurement, for example by reversing the Zener diode and measuring its forward diode voltage. It is also possible to leave $I_{b1}$ flowing continuously whilst making $I_{b2}$ add or subtract to it during the second period $t_2$.

What is claimed is:

1. A method for providing bias current to and sensing the voltage of a Zener reference diode such that at least two current values are applied occurring in at least two periods of time one of such values being selected for desired Zener reference characteristics and during which the Zener voltage is sampled or measured and the other being chosen such that the average current during both periods provides a selected degree of power dissipation to set a required temperature of operation of the Zener diode.

2. A method according to claim 1 where the relative duration of the two said periods is adjusted and chosen such that the average current during both periods provides a selected degree of power dissipation to set a required temperature of operation of the Zener diode.

3. A method according to claim 1 or 2 where the Zener reference diode comprises a silicon chip on which a Zener or avalanche diode is diffused together with a temperature compensation transistor or temperature compensation diode.

4. A method according to claim 1, 2 or 3 where the temperature sensor is also integrated on to the said silicon chip or is the said compensation transistor or diode or is the said Zener diode connected in forward bias mode for a period of time in order to sense the temperature.

5. A method according to claim 3 or 4 where the said adjusted second bias current or average current is controlled to maintain constant or near constant output from said temperature sensor regardless of chances in ambient temperature.

6. A method according to claims 3, 4, or 5 where a third period is used to measure or sample said sensed value of temperature.

* * * * *